US006983498B2

(12) United States Patent
Peterson et al.

(10) Patent No.: US 6,983,498 B2
(45) Date of Patent: Jan. 10, 2006

(54) SLEEPING BAG WITH CINCHING MECHANISM

(75) Inventors: Michael W. Peterson, Park City, KS (US); Susan L. Michaelis, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/791,072

(22) Filed: Mar. 1, 2004

(65) Prior Publication Data

US 2005/0188461 A1 Sep. 1, 2005

(51) Int. Cl.
*A47G 9/08* (2006.01)

(52) U.S. Cl. ..... 5/413 R; 24/129 B

(58) Field of Classification Search ..... 5/413 R, 5/413 AM, 417, 420, FOR 42; 100/2, 5; 53/399, 430; 24/129 B, FOR 129 B
See application file for complete search history.

(56) References Cited

U.S. PATENT DOCUMENTS

| | | | | |
|---|---|---|---|---|
| 730,877 | A | 6/1903 | Clapham | |
| 872,404 | A | 12/1907 | Burch | |
| 917,403 | A | 4/1909 | Benger | |
| 1,253,039 | A | 1/1918 | Hunt et al. | |
| 1,281,692 | A | 10/1918 | Stonebridge | |
| 1,653,816 | A | 12/1927 | Millar | |
| 1,704,182 | A * | 3/1929 | Ellery | 5/413 R |
| 1,915,044 | A | 6/1933 | Anderson | |
| 2,033,779 | A * | 3/1936 | Monk | 5/627 |
| 2,229,935 | A * | 1/1941 | Powers | 24/131 R |
| 2,368,220 | A * | 1/1945 | Hinds | 5/413 R |
| 2,720,664 | A | 10/1955 | Stephenson | |
| 2,870,464 | A * | 1/1959 | Lalick | 5/484 |
| 2,913,043 | A | 11/1959 | Achner | |
| 2,972,767 | A | 2/1961 | Adrian | |
| 3,268,922 | A * | 8/1966 | Moxley | 5/420 |
| 3,477,552 | A | 11/1969 | Goldman | |
| 3,597,764 | A | 8/1971 | Povey | |
| 3,750,202 | A | 8/1973 | Merikallio | |
| 3,860,157 | A * | 1/1975 | Richards et al. | 224/153 |
| 4,125,910 | A * | 11/1978 | Nicholai | 2/69.5 |
| 4,128,908 | A | 12/1978 | Kerbs | |
| 4,149,540 | A * | 4/1979 | Hasslinger | 606/203 |
| 4,158,250 | A * | 6/1979 | Ringwald | 24/16 R |
| 4,223,056 | A | 9/1980 | Di Fronzo | |
| 4,292,700 | A | 10/1981 | Market | |

(Continued)

FOREIGN PATENT DOCUMENTS

DE 29601617 U1 3/1996

(Continued)

OTHER PUBLICATIONS

Copy of Invitation to Pay Additiional Fees with partial international search (Annex) by the EPO (Nov. 4, 2004).

*Primary Examiner*—Michael Safavi
*Assistant Examiner*—Gay Ann Spahn
(74) *Attorney, Agent, or Firm*—Leydig, Voit & Mayer Ltd.

(57) ABSTRACT

A sleeping bag having a cinch mechanism that can be closed with a single hand. The cinch mechanism includes, for example, a loop and a cord attached at an end of the sleeping bag. When the sleeping bag has been rolled, the loop is pulled in one direction, while the cord is pulled in the other direction. The cord is then extended through the loop, and pulled back and attached to itself. For example, a clasp may be used to attach the cord to itself.

13 Claims, 2 Drawing Sheets

U.S. PATENT DOCUMENTS 4,329,747 A * 5/1982 Russell ..... 5/420
4,370,767 A * 2/1983 Fraser ..... 5/417
4,513,461 A 4/1985 Tardivel
4,574,397 A 3/1986 Dennard
4,575,876 A 3/1986 Weaver
4,587,682 A 5/1986 Schultz
4,601,076 A * 7/1986 Knobeloch ..... 5/413 R
4,905,990 A * 3/1990 DeSantis ..... 482/23
5,199,135 A * 4/1993 Gold ..... 24/16 R
5,210,891 A * 5/1993 Avital et al. ..... 5/420
5,210,911 A * 5/1993 Brown et al. ..... 24/18
D341,513 S * 11/1993 Reeves et al. ..... D6/596
5,265,292 A * 11/1993 Underell ..... 5/419
5,303,874 A 4/1994 Le Masters
D346,923 S 5/1994 Holm
5,404,600 A 4/1995 DeMars
D365,485 S 12/1995 Rossman
5,509,141 A 4/1996 Saltzman
5,548,871 A * 8/1996 Trethewey ..... 24/16 R
D377,879 S 2/1997 Walden
5,603,591 A * 2/1997 McLellan ..... 410/97
5,715,578 A * 2/1998 Knudson ..... 24/16 PB
5,887,299 A 3/1999 Phillips
5,887,301 A 3/1999 Anderson
5,950,260 A * 9/1999 Dees ..... 5/420
D420,780 S 2/2000 Cox et al.
D426,049 S 6/2000 Biskner et al.
6,112,963 A * 9/2000 Pratt ..... 224/250
6,141,805 A * 11/2000 Fisher-Cohen et al. ..... 5/420
6,199,232 B1 3/2001 Kocivar
6,311,330 B1 11/2001 Rothman
6,330,949 B1 * 12/2001 DeRisio ..... 211/85.7
6,349,865 B1 * 2/2002 Tolley et al. ..... 224/404
6,367,083 B1 4/2002 November
6,438,774 B1 8/2002 Michaelis et al.
6,557,192 B2 5/2003 Zheng
D476,516 S 7/2003 Pigg
6,701,580 B1 * 3/2004 Bandyopadhyay ..... 24/16 R
6,842,948 B2 * 1/2005 Smith ..... 24/16 R
2002/0078501 A1 6/2002 Lamke
2002/0083525 A1 7/2002 Zheng
2002/0104162 A1 8/2002 Stewart
2003/0167605 A1 * 9/2003 Schultz ..... 24/306

FOREIGN PATENT DOCUMENTS

FR 2369490 A * 6/1978
GB 6465 12/1915
GB 115369 5/1918
GB 898653 * 6/1962

* cited by examiner

SLEEPING BAG WITH CINCHING MECHANISM

TECHNICAL FIELD OF THE INVENTION

The present invention is directed to sleeping bags, and more particularly to a sleeping bag that is rolled into a tight formation for storage and transportation.

BACKGROUND OF THE INVENTION

In general, a sleeping bag is a bag that is warmly lined or padded for sleeping outdoors, for example in a camper or a tent. Sleeping bags may also be used for sleeping on the floor inside a house, such as on a sleepover, or may be used as convenient bedding material when traveling.

Sleeping bags typically include a bottom portion, upon which an individual within the sleeping bag lays, and a top portion which extends over the person to cover the individual. Often, the top and bottom portions are made of a single, large rectangular insulated or padded fabric that is folded and attached along bottom and side edges to form the bag. The attachment is typically made by a zipper.

Sleeping bags are often folded in half lengthwise and rolled into a tight ball for transportation and storage. After rolled, most rolled rectangular sleeping bags are tied with tie cords, compression straps, or elastic straps, or may be otherwise secured so that the sleeping bag does not become unrolled during transportation and storage.

One problem associated with rolling of sleeping bags is that once the sleeping bag is folded (for example, lengthwise), it is often difficult to roll the sleeping bag without the edges of the sleeping bag being forced apart during the rolling process. For this reason, many users find it difficult to roll the sleeping bags into a tight, tidy configuration so that closure may be secured for transportation and storage. Moreover, even if a user can roll the sleeping bag into the tight configuration, the user may find tying the bag difficult, because tying the cords requires two hands, leaving no hands for holding the bag in the tightly rolled configuration. Often a user has to sit on the bag while tying it, or drive his or her knees into the bag to keep it from unrolling.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a sleeping bag is provided having a cinch mechanism that can be closed with a single hand. The cinch mechanism includes, for example, a loop and a cord attached at an end of the sleeping bag. When the sleeping bag has been rolled, the loop is pulled in one direction, while the cord is pulled in the other direction. The cord is then extended through the loop, and pulled back and attached to itself. For example, a clasp may be used to attach the cord to itself.

The loop provides a structure that extends across the folded sleeping bag and holds the folded and rolled sleeping bag in position after the cord has been attached to itself. The combined cord and loop system provide a quick and easy cinching mechanism for a sleeping bag.

In accordance with an embodiment, a clasp for attaching the cord to itself includes a hook which is extended around the cord and remains attached to the cord by friction. A thinner or narrower portion may be provided so that the clasp fits a user's hand. Alternate embodiments of clasps may include more than one hook, providing a variety of different options for attaching the clasp to the cord.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
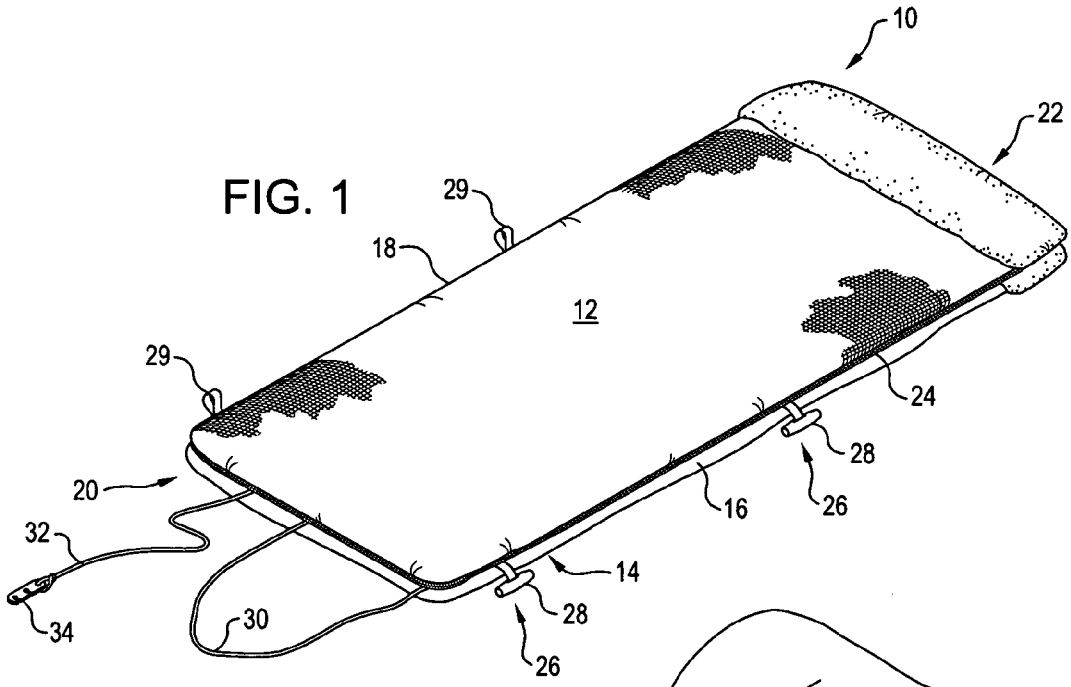
FIG. 1 is a perspective view one embodiment of a sleeping bag.

Referring now to the drawings, in which like reference numerals represent like parts throughout the several views, FIG. 1 shows a sleeping bag 10 in accordance with an embodiment. The sleeping bag 10 includes a top 12 and a bottom 14. Left and right edges 16, 18 extend along sides of the sleeping bag 10. The sleeping bag 10 includes a foot 20 and a head 22. A zipper 24 extends along the foot 20 and the right edge 18 of the sleeping bag 10.

The sleeping bag 10 is of a standard configuration, and in the embodiment shown is generally a rectangular bag formed by the top 12 being folded over the bottom 14, and connection of the top 12 and bottom 14 by the zipper 24. Although the configuration of the sleeping bag 10 in the drawings utilizes a fold-over construction and connection by a zipper, many other configurations may be utilized. For example, a bag may be formed in which a connection is made at the top or bottom of the sleeping bag, instead of along the side edges. In addition, the bag may be folded and sewn or otherwise permanently connected. The top 12 and the bottom 14 may be formed of two different pieces, and may be connected along their edges to form a sleeping bag.

Furthermore, although shown as a rectangle, the sleeping bag may have any shape, including a mummy shape, a more square, or "double" shape, or other configurations.

Figure 2:
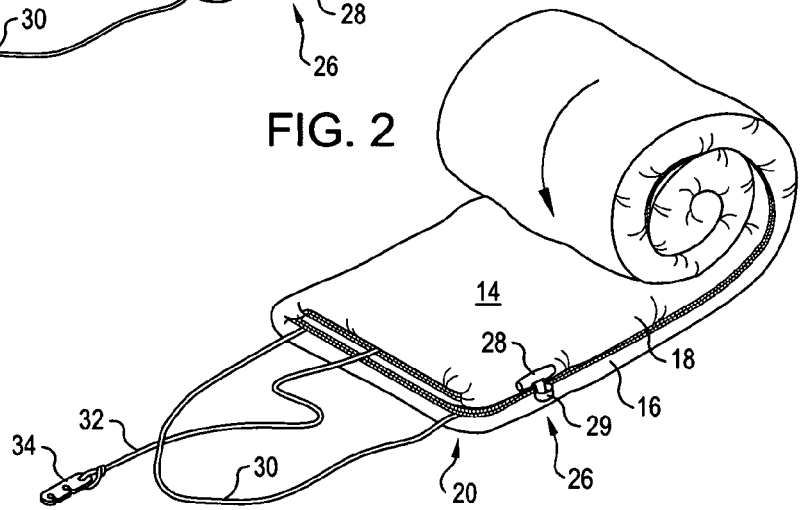
FIG. 2 is a side perspective view showing the sleeping bag of FIG. 1 folded and partially rolled.

In accordance with an embodiment of the invention, the sleeping bag 10 is folded such as is shown in FIG. 2 and then is rolled for storage (partial rolling is shown in FIG. 2 for the benefit of the reader). Although the embodiment shown in the drawings includes a sleeping bag 10 that is folded lengthwise, other embodiments may be folded in other ways: as nonlimiting examples, in thirds or fourths, folded along a diagonal, or folded both along a width and a length.

In accordance with an embodiment, one or more retainers 26 are provided for holding sections or layers of the sleeping bag 10 together after the sleeping bag has been folded. The retainers 26 are devices for holding the folded sections of the sleeping bag together. To this end, the retainers 26 may aid in maintaining alignment of the folded sections during rolling of the sleeping bag 10 along a fold line (i.e., the line formed at the fold of two sections or layers). That is, the retainers 26 limit lateral separation of the left and right edges 16, 18 of the folded sleeping bag 10 during rolling. In this manner, a desired even width roll of the sleeping bag 10 is facilitated, without a user being required to realign the folded layers of the sleeping bag 10 during rolling along a fold line. Although the shown embodiment includes retainers 26, the invention may be practiced on a sleeping bag not having a retainer 26.

In the embodiment shown, two retainers 26 are used on the sleeping bag 10, but any number, including one or none, may be used. The retainers 26 each include a toggle 28 and a loop 29, as can best be seen in FIG. 1. When the sleeping bag 10 is folded lengthwise, the toggles 28 are placed within the loops 29, locking the upper layer of the folded portion of the sleeping bag 10 against the lower layer of the folded portion of the sleeping bag 10. In this manner, the sleeping bag 10 may be rolled along its fold line, as is shown in FIG. 2, with only limited movement of the upper layer of the folded portion relative to the lower layer of the folded portion. Alternatively, if a retainer 26 is not used, a user may keep the upper section of the folded sleeping bag 10 aligned relative to the lower section by carefully controlling the rolling of the sleeping bag 10.

In accordance with an embodiment of the invention, a cinching mechanism is provided for holding the sleeping bag 10 in the rolled position. In the embodiment shown in FIG. 1, the cinching mechanism includes the loop 30 and a cord 32. The loop 30 and the cord 32 are attached at the foot 20 of the sleeping bag 10 but may alternatively be attached to the head 22 or at another location so that the loop 30 and the cord 32 are available after the sleeping bag 10 has been rolled. The loop 30 and the cord 32 may each be formed of the same material, or may be formed of different materials, but preferably are formed of elongate flexible material, such as rope, cord, fabric, or other suitable material. In addition, if desired, elastic may be used in one or both the loop 30 and the cord 32.

Figure 6:
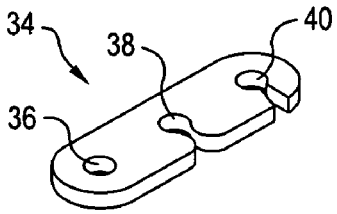
FIG. 6 is a side perspective view of an embodiment of a clasp in accordance with an embodiment of the invention.

In accordance with an embodiment, a clasp 34 (FIGS. 1, 2 and 6) is provided at the end of the cord 32. The clasp 34 is configured so that it may be attached to the cord 32 without slipping. In the embodiment of the clasp 34 shown in FIG. 6, a hole 36 is provided at one end for attaching to the cord 32, and first and second openings 38, 40 are positioned at a midway point at distal end, respectively, of the clasp 34.

Figure 3:
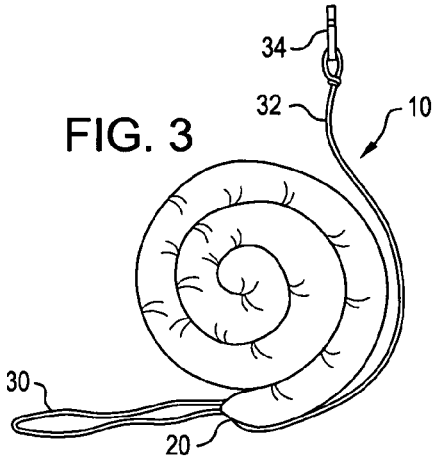
FIG. 3 is a side view of the sleeping bag of FIGS. 1 and 2, with the sleeping bag fully rolled.
Figure 4:
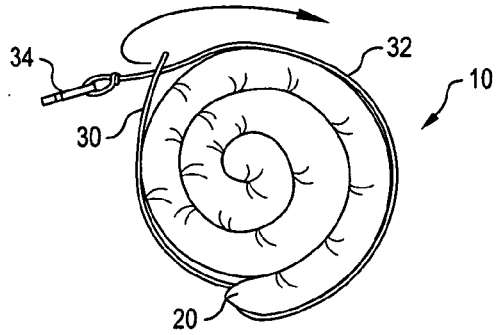
FIG. 4 is a side view of the sleeping bag of FIGS. 1–3, with a loop and cord system extending around the sleeping bag.

In use, a user rolls the sleeping bag 10 into a round configuration, such as is shown in FIG. 3. The loop 30 is then pulled tight around the outer surface of the sleeping bag 10, preferably in the direction of rolling of the sleeping bag 10 (e.g., in the embodiment shown, continuing in the direction of the foot 20 in the rolled sleeping bag 10). The cord 32 is extended in the opposite direction and through the loop 30 (FIG. 4). The end of the cord 32 to which the clasp 34 is attached is then attached to the portion of the cord 32 that extends along the outer surface of the rolled sleeping bag 10.

Before attaching the clasp 34 to the cord 32, a user may pull on the end of the cord 32 (e.g., by pulling on the clasp 34), tightening the loop 30 and the cord 32 against the outer surface of the sleeping bag 10 an pulling on the connection points where the loop 30 and cord 32 are connected to the sleeping bag 10, thus cinching the sleeping bag 10 into place. The clasp 34 may then be used to attach the end of the cord 32 to the portion of the cord 32 that is already extending around the sleeping bag 10, locking the sleeping bag in the cinched position.

Figure 5:
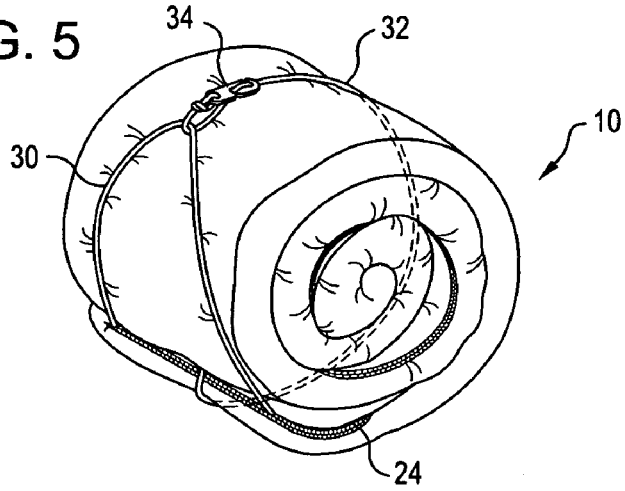
FIG. 5 is a side perspective view of the rolled sleeping bag of FIG. 4, with the cord attached to itself via a clasp.

In the embodiment of the clasp 34 shown in FIG. 5, two hooks are formed by the first and second openings 38, 40. Either of these openings 38, 40 may be extended around the portion of the cord 32 attached to the sleeping bag 10. Alternatively, the cord 32 may be looped through both of the openings 38, 40.

The clasp 34 is preferably of a size and thickness such that the tension in the cord 32, the friction of the contact of the cord with the inside of the opening 38 and/or the opening 40, and/or the bend in the cord formed by the clasp 34 prevents slippage of the clasp 34 relative to the cord 32 when the clasp 34 is attached. Slippage is also prevented by the contact of the clasp 34 with the outer surface of the sleeping bag 10 when the sleeping bag 10 is in the rolled configuration in FIG. 5.

After the sleeping bag 10 is in the position of FIG. 3, a user may grasp the clasp 34 with a single hand, run it through the loop 30 into the position in FIG. 4, and pull back and attach the clasp 34 in the position of FIG. 5. The other hand is left free to hold the sleeping bag 10 in position.

In the embodiment shown in FIG. 1, the loop 30 is attached adjacent to the left edge 16, and the cord 32 is attached adjacent to the right edge 18. Thus, when the sleeping bag 10 is folded in half (FIG. 2), the loop 30 is attached to the lower half of the sleeping bag 10 and the cord 32 is attached to the upper half. In accordance with an embodiment, the two ends of the loop 30 are attached so that they extend approximately to the outer edges of the folded sleeping bag 10 so that when the sleeping bag 10 is rolled, the loop 30 supports the outer portions of the sleeping bag 10. In the embodiment shown in FIGS. 1 and 2, the cord 32 is positioned approximately at the middle of the two ends of the loop 30, so that it supports the central portion of the sleeping bag 10.

If desired, the loop 30 may include more than two attachments to the sleeping bag 10 so that additional support for the sleeping bag 10 may be provided. Alternatively, the loop 30 may be formed of two or more lines that are attached to one another to form a loop structure. The cord 32 may be provided as a loop 30, or may include more than one structure attached to the sleeping bag 10 so that additional support is provided for the rolled sleeping bag 10.

If desired, the loop 30 and the cord 32 may both be attached to the bottom half of the sleeping bag 10 as folded in FIG. 2, or to the top half. In addition, the positions of the two may be switched so that the loop 30 is attached to the top half and the cord 32 is attached to the bottom half. However, in the configuration shown in FIG. 2, the loop 30 extends along the outside of the sleeping bag 10 in the same direction as the foot 30 is extending and is attached to the lower (outer) portion of the rolled sleeping bag. Thus, when pulled into place, the loop 30 tightens the rolled configuration of the sleeping bag 10, and traps the upper (inner) portion of the sleeping bag inside the lower (outer) portion. As such, arranging the loop in this manner prevents material from the sleeping bag 10 from extending beyond the rolled configuration.

Figure 7:
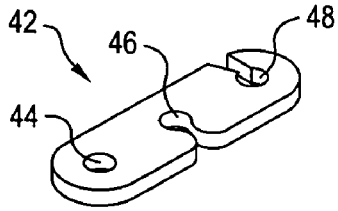
FIG. 7 is a side perspective of an alternate embodiment of a clasp in accordance the invention.

An alternate embodiment of a clasp 42 is shown in FIG. 7. This clasp 42 also includes a hole 44 for attaching to the end of the cord 32 and first and second openings 46, 48. However, the first and first and second openings 46, 48 open on opposite edges of the clasp 42, providing additional flexibility in attaching the clasp 42 to the portion of the cord 32 that is wrapped against the sleeping bag 10. Specifically, the openings 46, 48 may individually be attached to the portion of the cord 32 that extends around the outer surface of the sleeping bag 10 by sliding the opening 46 to the right or by sliding the opening 48 to the left. Alternatively, the two openings 46, 48 may be aligned against the cord 32 and rotated so as to lock the clasp 42 into place.

Figure 8:
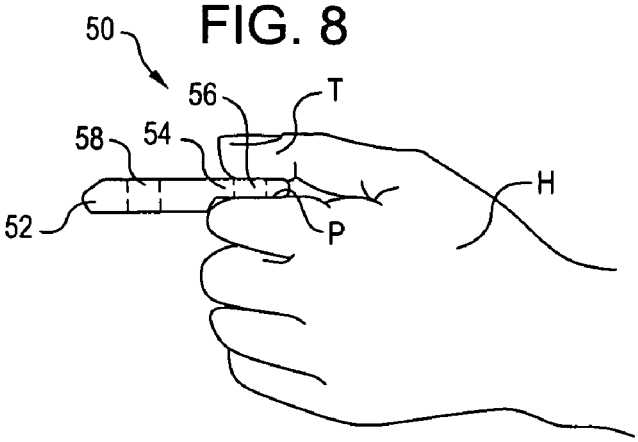
FIG. 8 is a side view of yet another alternate embodiment of a clasp in accordance with the invention, with the clasp being held in a user's hand.
Figure 9:
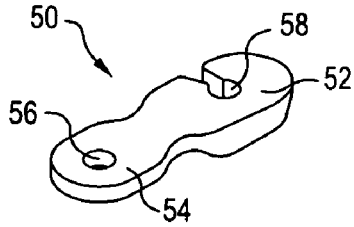
FIG. 9 is a top perspective view of the clasp of FIG. 8.

An additional embodiment of the clasp 50 is shown in FIGS. 8 and 9. This clasp 50 includes a thicker portion 52 and a thinner or narrowed portion 54. A hole 56 is located in the thinner portion 54 for attachment to the end of the cord 32. An opening 58 extends into the thicker portion 52 for attachment to the portion of the cord 32 that extends around the outer surface of the sleeping bag 10.

The thicker portion 52 provides an advantage in that it provides a greater surface area of the clasp 50 that is in contact with the portion of the cord 32 that extends around the outer surface of the sleeping bag 10. In this manner, friction is increased and a greater bend is formed in the cord 32, decreasing the likelihood that the clasp 50 may slip on the cord 32. In addition, the arrangement of the thicker portion 52 and the thinner portion 54 makes the clasp 50 fit the hand H of a user well, in that the thinner portion 54 may be grasped between a thumb T and pad P of an index finger, as shown in FIG. 8. This arrangement provides a positive teaching aid in use of the clasp 50, in that it suggests to a user the single-handed operability of attaching the cord 32 and loop 30 of the present invention.

Other clasps may be used, for example, ties, hook and loop fasteners, buttons, snaps, clips, clamps, or other devices that connect an end of the cord 32 to the remaining portion of the cord 32. In addition, if desired, a clasp may be designed for attachment directly to the loop 30, providing a loose attachment of the cord to the loop. However, this feature does not provide a cinching feature unless the clasp attachment may be varied, such as by use of a hook and loop fastener. Thus, for such an embodiment, the user may not roll the sleeping bag 10 tightly enough or may roll the sleeping bag 10 too tightly for the clasp to appropriately fit. The cord may also be tied to itself. If desired, a loop or other structure may be provided along the cord to which the free end of the cord may be tied.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sleeping bag, comprising:

a cinch mechanism for maintaining the sleeping bag in a rolled configuration, the cinch mechanism comprising:

an elongate flexible material connected to the sleeping bag and configured so as to form a loop;

a cord connected to the sleeping bag and that is a separate element independent of the elongate flexible material; and a clasp attached to the cord;

wherein the loop, the cord, and the clasp are arranged and configured such that, when the sleeping bag is rolled, the elongate flexible material wraps around the sleeping bag, the cord is extended through the loop, and the clasp is attached to a portion of the cord so as to hold the elongate flexible material and the cord in place, and wherein pulling on the clasp relative to the loop prior to attaching the clasp to the portion of the cord pulls at connection points for the cord and elongate flexible material and thereby tightens the roll of the sleeping bag.

2. The sleeping bag of claim 1, wherein the elongate flexible material is connected directly to and extends from a foot of the sleeping bag.

3. The sleeping bag of claim 2, wherein the cord is connected directly to and extends from the foot of the sleeping bag.

4. The sleeping bag of claim 1, wherein the cord is connected directly to and extends from a foot of the sleeping bag.

5. The sleeping bag of claim 1, wherein, when the sleeping bag is folded lengthwise, the elongate flexible material is connected directly to and extends from a bottom half of the sleeping bag.

6. The sleeping bag of claim 5, wherein, when the sleeping bag is folded lengthwise, the cord is connected directly to and extends from a top half of the sleeping bag.

7. The sleeping bag of claim 1, wherein the clasp comprises an opening for hooking onto a portion of the cord that extends against an outer surface of the sleeping bag.

8. The sleeping bag of claim 7, wherein the clasp is configured to fit a hand of a user.

9. The sleeping bag of claim 8, wherein the clasp includes a narrowed portion for attaching to the cord and for grasping with a hand, and a thickened portion including the opening.

10. The sleeping bag of claim 1, wherein the loop comprises two connections of the elongate flexible material to outer portions of the sleeping bag when the sleeping bag is rolled, the loop being formed by the elongate flexible material between the two connections.

11. A sleeping bag, comprising:

a cinch mechanism for maintaining the sleeping bag in a rolled configuration, the cinch mechanism comprising:

an elongate flexible material connected to the sleeping bag and configured so as to form a loop;

a cord connected to the sleeping bag; and a clasp attached to the cord, the clasp comprising two openings for hooking onto a portion of the cord that extends against an outer surface of the sleeping bag;

wherein the loop, the cord, and the clasp are arranged and configured such that, when the sleeping bag is rolled, the elongate flexible material wraps around the sleeping bag, the cord is extended through the loop, and the clasp is attached to a portion of the cord so as to hold the elongate flexible material and the cord in place, and wherein pulling on the clasp relative to the loop prior to attaching the clasp to the portion of the cord pulls at connection points for the cord and elongate flexible material and thereby tightens the roll of the sleeping bag.

12. The sleeping bag of claim 11, wherein the two openings are located on opposite sides of the clasp.

13. The sleeping bag of claim 11, wherein the two openings are located on the same side of the clasp.

* * * * *